US009042745B2

(12) United States Patent
Yoshida et al.

(10) Patent No.: US 9,042,745 B2
(45) Date of Patent: May 26, 2015

(54) DEVELOPER AMOUNT DETECTOR, IMAGE FORMING APPARATUS INCORPORATING SAME, AND POSITIONING STRUCTURE FOR POSITIONING UNIT WITHIN IMAGE FORMING APPARATUS

(75) Inventors: Tomofumi Yoshida, Osaka (JP); Tomohiro Kubota, Osaka (JP); Yoshiyuki Shimizu, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 448 days.

(21) Appl. No.: 13/344,940

(22) Filed: Jan. 6, 2012

(65) Prior Publication Data

US 2012/0189326 A1 Jul. 26, 2012

(30) Foreign Application Priority Data

Jan. 20, 2011 (JP) ..... 2011-010015
Feb. 18, 2011 (JP) ..... 2011-033159

(51) Int. Cl.
*G03G 15/08* (2006.01)

(52) U.S. Cl.
CPC .... *G03G 15/0856* (2013.01); *G03G 2215/0891* (2013.01); *G03G 15/0862* (2013.01); *G03G 15/0889* (2013.01)

(58) Field of Classification Search
CPC ..... G03G 15/0827; G03G 15/0855; G03G 2215/0888; G03G 2215/0891; G03G 2215/0894; G03G 15/0831; G03G 15/0862
USPC ..... 399/27, 30, 61, 62, 64
See application file for complete search history.

(56) References Cited

U.S. PATENT DOCUMENTS

2005/0117921 A1* 6/2005 Ishiguro et al. ..... 399/27
2008/0292331 A1* 11/2008 Yokomori et al. ..... 399/27

(Continued)

FOREIGN PATENT DOCUMENTS

CN 1728013 A 2/2006
CN 101592898 A 12/2009

(Continued)

OTHER PUBLICATIONS

Combined Chinese Office Action and Search Report issued May 31, 2013 in Patent Application No. 201210008207.4 with English Translation of Category of Cited Documents.

(Continued)

*Primary Examiner* — Walter L Lindsay, Jr.
*Assistant Examiner* — Milton Gonzalez
(74) *Attorney, Agent, or Firm* — Oblon, McClelland, Maier & Neustadt, L.L.P.

(57) ABSTRACT

A developer amount detector for detecting an amount of developer contained in a unit removably installable in an image forming apparatus, including optical elements having a light-emitting element to emit light and a light-receiving element to receive the light; two light-guiding members, provided in the unit, to guide the light from the light-emitting element to the light-receiving element; a holder, held in the image forming apparatus, to hold the optical elements, movable in a direction orthogonal to optical axes of the optical elements as the unit is being installed in the image forming apparatus; and a positioning mechanism to position the unit within the image forming apparatus by restricting movement of the holder in the direction orthogonal to the optical axes relative to the unit in a state in which the unit is installed in the image forming apparatus.

21 Claims, 12 Drawing Sheets

(56) References Cited

U.S. PATENT DOCUMENTS

| | | | | |
|---|---|---|---|---|
| 2009/0214230 | A1* | 8/2009 | Kweon et al. | 399/27 |
| 2009/0297175 | A1* | 12/2009 | Kakuta et al. | 399/27 |

FOREIGN PATENT DOCUMENTS

| | | | | |
|---|---|---|---|---|
| CN | 201364464 | Y | | 12/2009 |
| JP | 62-254159 | | | 11/1987 |
| JP | 63-78170 | | | 4/1988 |
| JP | 2-284165 | | | 11/1990 |
| JP | 2001-305827 | | | 11/2001 |
| JP | 2002-40904 | | | 2/2002 |
| JP | 2005-31338 | | | 2/2005 |
| JP | 2005099458 | A | * | 4/2005 |
| JP | 2005266068 | A | * | 9/2005 |
| JP | 2005-345914 | | | 12/2005 |
| JP | 2006-65267 | | | 3/2006 |
| JP | 2007-147764 | | | 6/2007 |
| JP | 2007-219269 | | | 8/2007 |
| JP | 2008-83616 | | | 4/2008 |
| JP | 2008-122701 | | | 5/2008 |
| JP | 2009186835 | A | * | 8/2009 |
| JP | 2010-107775 | | | 5/2010 |

OTHER PUBLICATIONS

Japanese Office Action issued Oct. 22, 2014, in Japan Patent Application No. 2011-033159.

Office Action issued Feb. 13, 2015 in Chinese Patent Application No. 201210008207.4.

* cited by examiner

DEVELOPER AMOUNT DETECTOR, IMAGE FORMING APPARATUS INCORPORATING SAME, AND POSITIONING STRUCTURE FOR POSITIONING UNIT WITHIN IMAGE FORMING APPARATUS

CROSS-REFERENCE TO RELATED APPLICATIONS

This patent application is based on and claims priority pursuant to 35 U.S.C. §119 to Japanese Patent Application Nos. 2011-010015, filed on Jan. 20, 2011, and 2011-033159, filed on Feb. 18, 2011 in the Japan Patent Office, the entire disclosures of which are hereby incorporated by reference herein.

BACKGROUND OF THE INVENTION

1. Field of the Invention

The present invention generally relates to a developer amount detector for detecting an amount of developer in a unit that is removably installable in an image forming apparatus by using optical elements, an image forming apparatus incorporating the developer amount detector, and a positioning structure for positioning the unit within the image forming apparatus.

2. Description of the Background Art

Image forming apparatuses such as copiers, printers, facsimile machines, plotters, and multifunction machines capable of at least two of these functions in which components in the image forming apparatus are formed as modular units and the respective units are removably installable in apparatuses have been widely developed. In particular, a process unit in which a development device, a toner cartridge, and a photoreceptor are formed as a single integrated unit is known. As developer contained in the process unit is consumed in use, however, it is necessary to notify users when it is time to replace the process unit. Accordingly, a variety of detection systems to detect an amount of the developer in the process unit have been proposed.

One type of detection system is a light transmission detector that utilizes optical elements. The light transmission-type detector for detecting the amount of the developer irradiates light into a developer container that contains the developer, and the amount of the developer is detected based on a length of time needed for the light to transverse the container and a timing with which the light is detected.

More specifically, the light-transmission detector is constituted by, for example, a light-emitting element, a light-receiving element, and first and second light-guiding members constituted by prisms and mirrors provided in a process unit. With this configuration, the light emitted from the light-emitting element is guided to the developer container in the process unit through the first light-guiding member, and the light thus guided to the developer container is then guided out of the developer container to the light-receiving element through the second light-guiding member. The amount of the developer is determined by a time period during which the light-receiving element receives the light and a timing at which the light-receiving element receives the light.

However, when the process unit is installed in the image forming apparatus, positions of the first and the second light-guiding members can be displaced relative to positions of the light-emitting element and the light-receiving element provided in the image forming apparatus, which degrades detection accuracy.

In order to solve this problem, JP-H02-284165-A proposes a configuration in which a light-receiving element is attached to the image forming apparatus via a rotary lever. With this configuration, when a process unit is installed in an image forming apparatus, the process unit contacts the rotary lever and rotates it to the light-receiving element is accurately relative to the process unit.

However, in this configuration, the rotary lever and a big link mechanism to rotate the rotary lever are required, which increases both the number of components and the size of the device, which in turn increases costs.

SUMMARY OF THE INVENTION

The present invention provides an improved developer amount detector capable of positioning optical elements relative to a removably installable unit in an image forming apparatus using an uncomplicated configuration while downsizing the image forming apparatus.

In one exemplary embodiment of the present invention, a developer amount detector detects an amount of developer contained in a developer container in a unit that is removably installable in an image forming apparatus. The developer amount detector includes optical elements, light-guiding members, a holder, and a positioning mechanism. The optical elements have a light-emitting element to emit light and a light-receiving element to receive the light for detecting the amount of the developer in the unit. The light-guiding members are provided in the unit and guide the light emitted from the light-emitting element to the light-receiving element. The holder, held in the image forming apparatus, holds the optical elements and is movable in a direction orthogonal to optical axes of the optical elements as the unit is being installed in the image forming apparatus. The positioning mechanism positions the unit within the image forming apparatus by restricting movement of the holder in the direction orthogonal to the optical axes of the optical elements relative to the unit in a state in which the unit is installed in the image forming apparatus.

In another exemplary embodiment of the present invention, an image forming apparatus includes a latent image carrier to carry a latent image; a unit removably installable in the image forming apparatus, having a developer container; and the above-described developer amount detector.

In yet another exemplary embodiment of the present invention, a positioning structure positions a unit within an image forming apparatus. The positioning structure includes optical elements, light-guiding members, a containing space, a planar holder, a projection, and a hole. The optical elements have a light-emitting element to emit light and a light-receiving element to receive the light. The light-guiding members are provided in the unit and guide the light emitted from the light-emitting elements to the light-receiving element. The containing space formed in a vertical wall of the image forming apparatus is defined by a bottom and side faces in the vertical wall. The planar holder is smaller than the containing space in a direction orthogonal to optical axes of the optical elements and is accommodated within the containing space of the image forming apparatus. The holder is movable in a direction orthogonal to the optical axes of the optical elements as the unit is being installed in the image forming apparatus. The projection is formed in one of the holder and the unit. The hole is formed in the other of the holder and the unit to accommodate the projection as the unit is being installed in the image forming apparatus. The holder is held by the bottom of the containing space in a state in which the unit is not installed in the image forming apparatus. The holder is moved by inserting the projection into the hole when the unit is being installed in the image forming apparatus. The holder is held by the projection that is fitted into the hole to restrict the movement of the holder in the direction orthogonal to the optical axes of the optical elements relative to the unit in a state in which the unit is installed in the image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
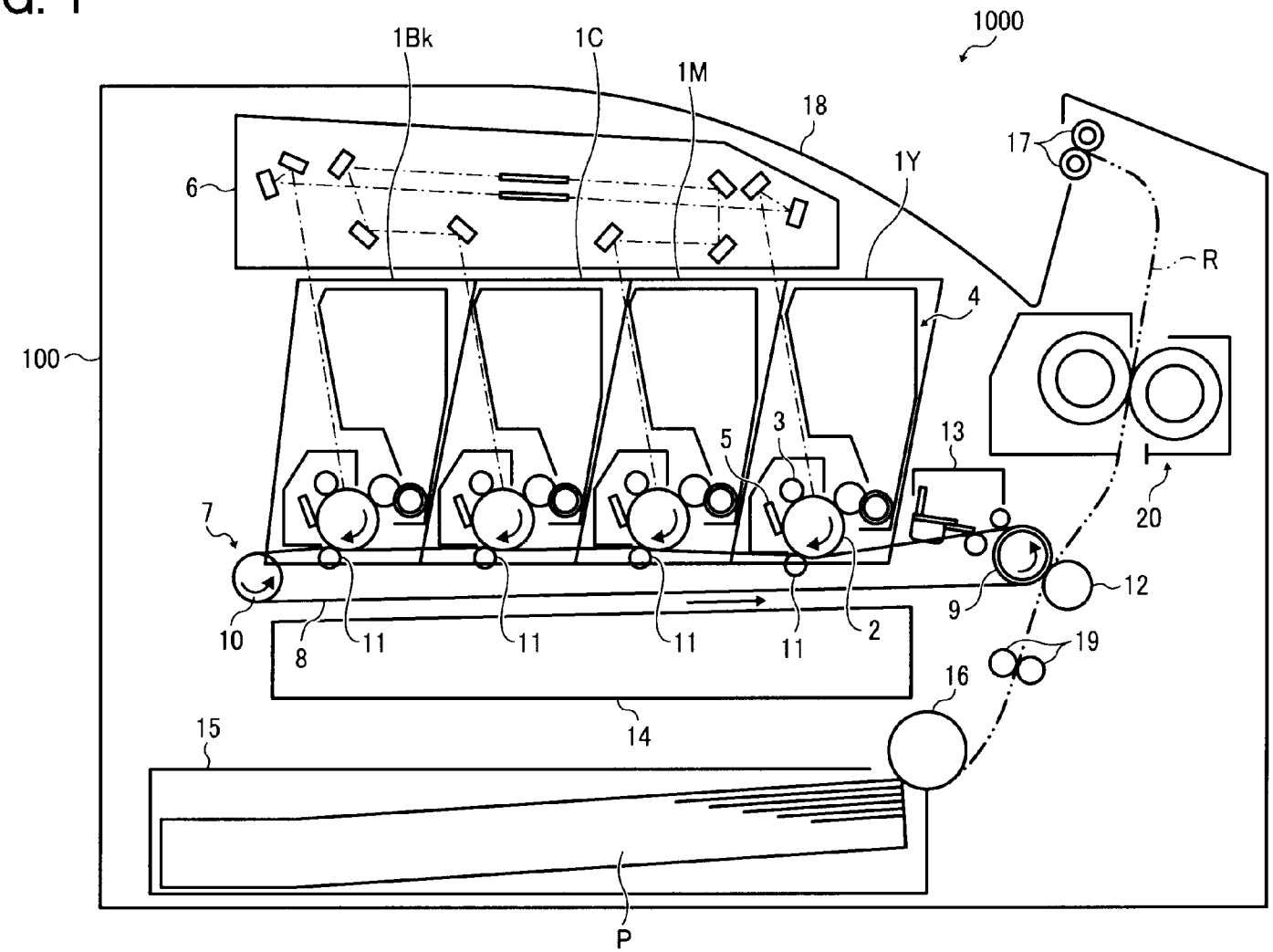
FIG. 1 is a schematic diagram illustrating an image forming apparatus according to a present disclosure.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result. Referring now to the drawings, wherein like reference numerals designate identical or corresponding parts throughout the several views thereof, and particularly to FIG. 1, an image forming apparatus that is an electrophotographic printer (hereinafter referred to as a printer) according to an illustrative embodiment of the present invention is described. It is to be noted that although the image forming apparatus of the present embodiment is a printer, the image forming apparatus of the present invention is not limited to a printer.

FIG. 1 is a schematic diagram illustrating a configuration of an image forming apparatus including one of developer amount detectors of the present disclosure. A description is now given of a tandem-type color laser printer (hereinafter referred to as an image forming apparatus 1000) according to illustrative embodiments. The image forming apparatus 1000 includes four process units 1Y, 1M, 1C, and 1Bk for respectively forming yellow, magenta, cyan, and black (hereinafter also simply "Y, M, C, and Bk") single-color toner images. The process units 1Y, 1M, 1C, and 1Bk are removably installable in an apparatus body 100 of the image forming apparatus 1000. It is to be noted that, in this specification, reference character suffixes Y, M, C, and Bk attached to an identical reference numeral indicate only that components indicated thereby are used for forming different single-color images, respectively, and hereinafter may be omitted when color discrimination is not necessary.

As illustrated in FIG. 1, each of the process units 1Y, 1M, 1C, and 1Bk includes a drum-shaped photoreceptor 2 functioning as a latent image carrier. A charging device including a charging roller 3 to charge a surface of the photoreceptor 2, a development device 4 to supply toner to the surface of the photoreceptor 2, and a cleaning device including a cleaning blade 5 to remove the toner on the surface of the photoreceptor 2 are disposed around the photoreceptor 2 in each of the process units 1Y, 1M, 1C, and 1Bk. It is to be noted that, for ease of description, reference numerals 2, 3, 4, and 5 are assigned to the photoconductor, the charging roller, the development device, and the cleaning blade, respectively, in the process unit 1Y for yellow, but are omitted in the process unit 1C, 1M, and 1Bk in FIG. 1.

An exposure unit 6 to expose the surface of the photoreceptor 2 is disposed above the process units 1Y, 1M, 1C, and 1Bk. The exposure unit 6 (serving as a latent image forming device) includes multiple light sources, f-θ lenses, reflection mirrors. The light sources in the exposure unit 6 emit light to the surfaces of the respective photoreceptors 2 in accordance with image data. Although the exposure unit 6 is disposed above the process units 1Y, 1M, 1C, and 1Bk as shown in FIG. 1, a light emitting diode (LED) constituting light sources in the exposure unit 6 may be arranged adjacent to the respective process units 1Y, 1M, 1C, and 1Bk.

A transfer unit 7 is disposed beneath the process units 1Y, 1M, 1C, and 1Bk. The transfer unit 7 includes an intermediate transfer belt 8 formed by an endless belt. The intermediate transfer belt 8 is looped around a driving roller 9 and a driven roller 10 both serving as support rollers. As the driving roller 9 rotates in a counterclockwise direction shown in FIG. 1, the intermediate transfer belt 8 is rotated in a direction indicated by arrow in FIG. 1.

Four primary transfer members 11, serving as a primary transfer members, are disposed facing the photoreceptors 2 via the intermediate transfer belt 8. The four primary transfer members 11 presses an internal faces of the intermediate transfer belt 8, and primary transfer nips are formed in portions contacting the intermediate transfer belt 8 with the photoreceptors 2Y, 2M, 2C, and 2Bk, respectively. The primary transfer rollers 11 are connected to a power source, and a predetermined direct current (DC) and/or alternating-current voltage (AC) is applied to the primary transfer rollers 11.

A secondary transfer roller 12, serving as a secondary transfer member, is disposed facing the driving roller 9. The secondary transfer roller 12 presses an outer circumferential surface of the intermediate transfer belt 8, and a second transfer nip is formed in a portion contacting the secondary transfer roller 12 with the intermediate transfer belt 8. The secondary transfer roller 12 is connected to a power source, and a predetermined direct current (DC) and/or alternating-current voltage (AC) is applied to the secondary transfer roller 12.

In addition, a cleaning device 13 to clean the surface of the intermediate transfer belt 8 is disposed facing to the outer circumferential surface of the intermediate transfer belt 8. A waste toner transport house extending from the cleaning device 13 is connected to an entrance of a waste-toner container 14 positioned beneath the transfer unit 7.

A sheet cassette 15 is disposed in a lower portion of the image forming apparatus 1000 and contains multiple recording media P such as paper sheet and overhead projector (OHP) sheet. A feeding roller 16 that feeds the recording medium P contained in the sheet cassette 15 is provided in the sheet cassettes 15. By contrast, a pair of discharging sheet rollers 17 to discharge the recording medium P and a discharge sheet tray 18 on which the discharged recording medium P is stacked are disposed in an upper portion of the image forming apparatus 1000.

A guide path R through which the recording medium P is transported from the sheet cassette 15 to the discharge sheet tray 18 via the secondary transfer nip is formed in the apparatus body 100 of the image forming apparatus 1000. A registration pair 19 is disposed in the guide path R on an upstream side from the second transfer roller 12 in a direction in which the recording medium P is conveyed. A fixing device 20 is disposed in the guide path R on a downstream side from the second transfer roller 12 in the direction in which the recording medium P is conveyed.

Next, a copying operation using the above-described image forming apparatus 1000 is described below with reference to FIG. 1. When copying operation is started, initially, the photoreceptors 2 in the process units 1Y, 1M, 1C, and 1Bk are rotated in the clockwise direction shown in FIG. 1, and the charging rollers 3 uniformly charge the photoreceptors 2 at a predetermined polarity. Then, the exposure device 6 irradiates the respective photoreceptors 2 with the respective laser beams or LED light in accordance with the image data from a scanner, thus forming latent images on the charged surface of the respective photoreceptors 2. The image data used for exposing the surfaces of the photoreceptors 2 is monochrome image data resolved from scanned multiple color image to color data of yellow, magenta, cyan, and black. Subsequently, the development devices 4 supply the toner to the photoreceptors 2 to visualize the latent image, thus forming yellow, magenta, cyan, and black of the single-color toner images on the photoreceptors 2 respectively.

In addition, when copying operation is started, the driving roller 9 is activated, thus rotating the intermediate transfer belt 8 in a direction indicated by arrow shown in FIG. 1. At this time, a constant voltage or constant current whose polarity is opposite to the charging polarity of the toner is applied to the respective primary transfer rollers 11, which forms a transfer electric field in the primary transfer nips formed between the primary transfer rollers 11 and the photoreceptors 2. After that, the primary transfer rollers 11 primary transfers the toner image on the photoreceptors 2 onto the intermediate transfer belt 8 using the transfer electric field in the primary transfer nips so that four toner image are superimposed one on another on the surface of the intermediate transfer belt 8. Thus, full color toner image is carried on the intermediate transfer belt 8. After the primary transfer process, residual toner in the surface of the photoreceptors 2 is removed by the cleaning blade 5, and then electrically discharged by a discharge device, as preparation for the subsequent image formation.

In addition, along with these processes, when the copying operation is started, the feed roller 16 sends out the recording medium P from the sheet cassettes 15. Then, the pair of registration rollers 19 stops the recording medium P from conveying in the guide path R. The registration rollers 19 forward the recording medium P to the secondary transfer nip between the intermediate transfer belt 8 and the secondary transfer roller 12, timed to coincide with the arrival of the multicolor toner image formed on the intermediate transfer belt 8. At this time, a transfer voltage whose polarity is opposite to the toner charging polarity of the toner image on the intermediate transfer belt 8 is applied to the secondary transfer roller 12, which forms a transfer electric field in the secondary transfer nip. Then, in the secondary transfer process, a superimposed four-color toner on the intermediate transfer belt 8 is transferred onto the recording medium P at one time. The recording medium P onto which multicolor image is transferred in the secondary transfer nip is transported to the fixing device 20, where the four-color toner image thus transferred is fixed on the surface of the recording medium P with heat and pressure in a fixing process. After the fixing process, the recording medium P is discharged toward the discharge sheet tray 18 located outside of the apparatus body 100 through the guide path R by the pair of discharging sheet rollers 17 and then is stacked on the discharge sheet tray 18.

It is to be noted that, although the image forming operation when the full color image is formed is described above, monochrome image can be formed by using one of the four process units 1Y, 1M, 1C, and 1Bk or the two or three color images can be formed using two or three of these process units 1Y, 1M, 1C, and 1Bk.

Figure 2:
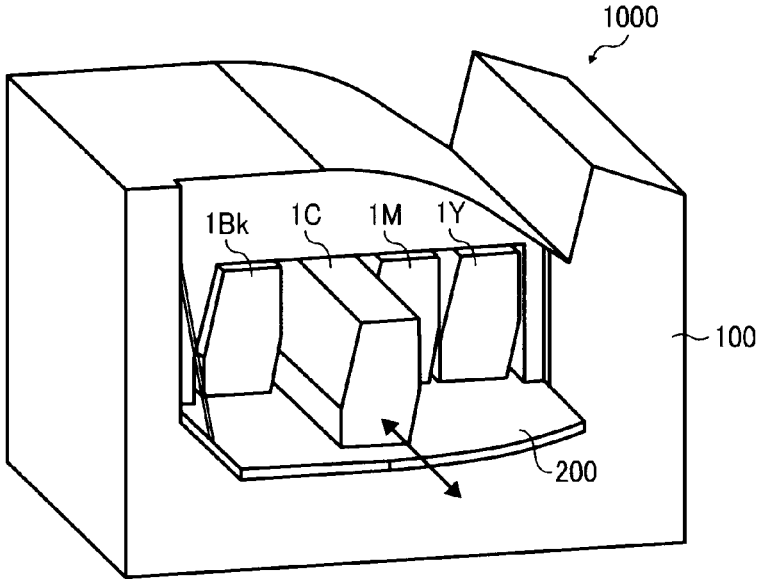
FIG. 2 is a diagram illustrating installation of process units in the image forming apparatus shown in FIG. 1.

FIG. 2 is a front view illustrating the process units 1 and a vicinity of an installation structure in the image forming apparatus shown in FIG. 1. As illustrated in FIG. 2, a front door 200 that can open and close a front side outer face of the image forming apparatus 1000 is provided in the apparatus body 100. When the front door 200 is opened, the process units 1Y, 1M, 1C, and 1Bk installed in the apparatus body 100 are exposed. In this state, the four process units 1Y, 1M, 1C, and 1Bk can be installed in and removed from the apparatus body 100 in a longitudinal direction and a horizontal direction.

Figure 3:
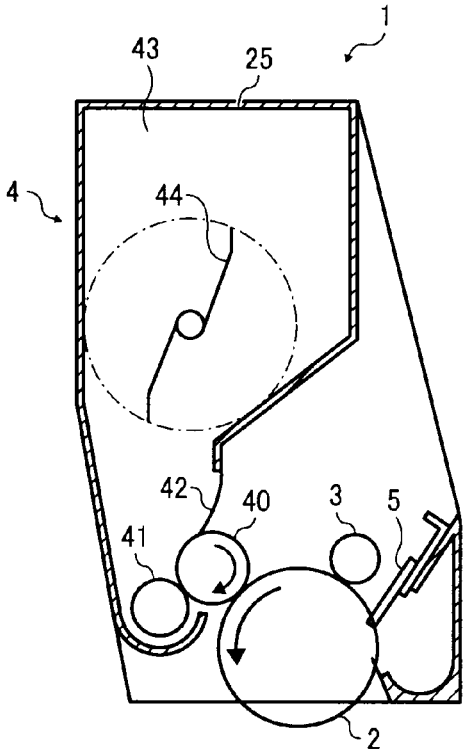
FIG. 3 is a schematic cross-sectional view of the process units 1 cutting a direction orthogonal to the longitudinal direction of the process unit shown in FIG. 2.

FIG. 3 is a schematic cross-sectional view of the process unit 1 cut in a direction orthogonal to the longitudinal direction of the process unit 1. That is, FIG. 3 shows a configuration of one of the process units 1Y, 1M, 1C, and 1Bk. It is to be noted that the suffixes Y, M, C, and Bk indicate only that components indicated thereby are used for forming yellow, magenta, cyan, and black images, respectively, and hereinafter may be omitted when color discrimination is not necessary.

As illustrated in FIG. 3, the development device 4 in the process unit 1 includes a development roller 40 to carry a toner, a supply roller 41 to supply the toner to the development roller 40, a development blade 42 to restrict the amount of the toner and form a thin thickness, a developer container 43 to contain the toner, and an agitator 44 to agitate the toner in the developer container 43. The process unit 1 is enveloped by a housing 25. The toner in the developer container 43 is beard on the development roller 40 by the supply roller 41, which forms the thin film charged at the predetermined polarity on the development roller 40. The development roller 40 is rotated in contact with the photoreceptor 2, and the latent image formed on the photoreceptor 2 is visualized by adhering the toner with the latent image thereon.

Configuration of Developer Amount Detector

Next, a developer amount detector 300 to detect the amount of the toner in the process unit 1 by using optical elements is described below.

Figure 4:
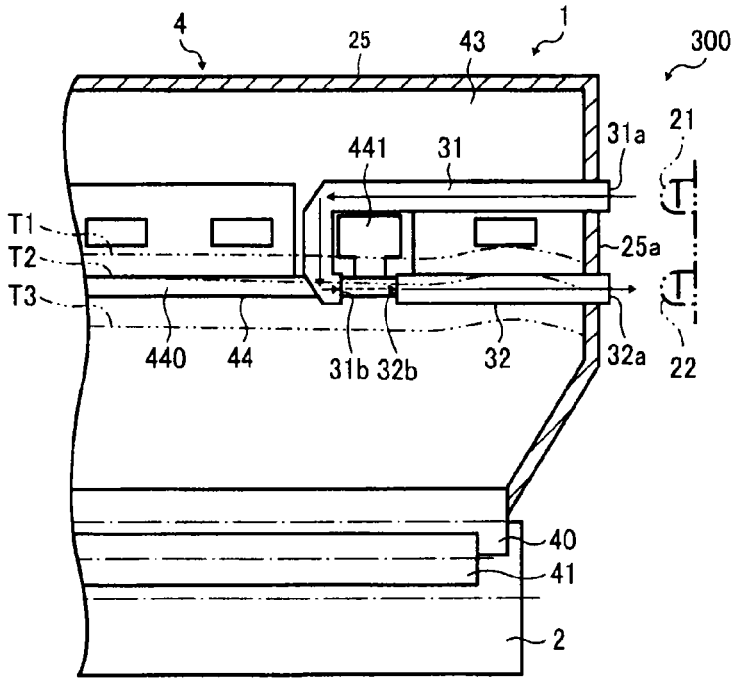
FIG. 4 is a schematic cross-sectional view of the process units 1 cutting a direction in parallel to the longitudinal direction of the process unit shown in FIG. 2.

FIG. 4 is a schematic cross-sectional view of the process units 1 cut in a direction in parallel to the longitudinal direction of the process unit 1. A light-emitting element 21 and a light-receiving element 22 are provided in the apparatus body 100, which is are described further detail later. As illustrated in FIG. 4, the process unit 1 includes light-guiding members 31 and 32 to guide light emitted from the light-emitting element 21 to the light-receiving element 22. These light-guiding members 31 and 32 are constituted by prisms that can bend and guide the light, which are disposed in the developer container 43 of the development device 4 so that the light can pass through the light-guiding members 31 and 32 in the developer container 43.

More specifically, outer end faces 31*a* and 32*a* are exposed to the housing 25 of the process unit 1. In a state in which the process unit 1 is installed in the apparatus body 100, the outer end face (exposed end face) 31*a* of the first light-guiding member 31 is positioned facing to the light-emitting element 21, and the outer end face (exposed end face) 32*a* of the second light-guiding member 32 is positioned facing to the light-receiving element 22. The inner end face 31*b* of the first light-guiding member 31 is disposed in face-to-face relation to the inner end face 32*b* of the second light-guiding member 32 in the developer container 43. With this configuration, the light emitted from the light-emitting element 21 enters into the outer end face 31*a* of the first light-guiding member 31 and is reflected in directions indicated by arrow shown in FIG. 4 and then exits the first light-guiding member 31 from the other face (inner end face) 31*b*. Then, the light enters the inner end face 32*b* of the second light-guiding member 32. The light entered in the second light-guiding member 32 exists from the outer end face 32*a* and then reaches the light-receiving element 22.

It is to be noted that the positions of the light-emitting element 21 and the light-receiving element 22 can be exchanged. However, it is preferable that the light-emitting element 21 be positioned away from the photoreceptor 2 so that exposing the surface of the photoreceptor 2 by light can be prevented.

Herein, a gap of a certain size is provided between the inner end face 31*b* of the first light-guiding member 31 and the inner end face 32*b* of the second light-guiding member 32, which are facing each other. A blade 441 provided around a rotary shaft 440 of the agitator 44 passes the gap between the inner end face 31*b* of the first light-guiding member 31 and the inner end face 32*b* of the second light-guiding member 32. While the blade 441 of the agitator 44 passes through the gap between the inner end faces 31*b* and 32*b*, the blade 441 slidably contacts the inner end faces 31*b* and 32*b*. Thus, the toner adhered on the inner end faces 31*b* and 32*b* is scrapped off, and the light transmission route can be formed.

In FIG. 4, broken lines indicated by reference numerals T1, T2, and T3 represent levels (top faces) of the toner contained in the developer container 43. As the toner is consumed, the level of the toner is gradually lowered from the position T1 to the position T3 via the position T2. In a state in which the level of the toner is positioned at the position T1 that is higher than the inner end faces 31*b* and 32*b* of the light-guiding members 31 and 32 facing each other, even when the blade 441 of the agitator 44 slides and contacts the inner end faces 31*b* and 32*b*, the toner positioned in vicinity of the inner end faces 31*b* and 32*b* is immediately adhered to the inner end faces 31*b* and 32*b*. Accordingly, since sufficient light cannot be transmitted from the first light-guiding member 31 to the second light-guiding member 32, the light does not reach the light-receiving element 22 or the detected light is not continuous because the insufficient light reaches the light-receiving element 22; and therefore, a time period during which the light-receiving element 22 can detect the light is quite short.

Then, the toner is consumed by the printing operation, and the level of the toner is lowered to the position T2 that is similar height as the inner end faces 31*b* and the 32*b* of the light-guiding members 31 and 32. In this state, the light transmission amount and the light transmission time transmitting from the first light-guiding member 31 to the second light-guiding member 32 are increased, and as a result, the time period during which the light-receiving element 22 can detect the light can be increased. More particularly, immediately after the blade 441 of the agitator 44 passes through the gap between the inner end faces 31*b* and 32*b*, because the amount of the toner presenting a position between the inner end faces 31*b* and 32*b* is the least in the states shown in FIG. 15, the light is easily to transmit therebetween.

After that, when the toner is further consumed, the level of the toner is lowered to the position T3 that is lower than the inner end faces 31*b* and 32*b*. In this state, the light transmission amount and the light transmission time from the first light-guiding member 31 to the second light-guiding member 32 is further increased and the time period during which the light-receiving element 22 can detect the light is further increased.

That is, the light-guiding member 31, serving as a first light-guiding member, has the outer end face 31*a* facing the light emitted from the light-emitting element 21 and the inner end face 31*b* positioned inside the unit 1 and guides the light from the outer end face 31*a* to the inner end face 31*b* thereof. The light-guiding member 32, serving as a second light-guiding member, has the inner end face 32*b* facing the inner end face 31*b* of the first light-guiding member 31 in the unit to receive the light from the inner end face 32*b* of the first light-guide member 32 through the developer in the unit 1 and the outer end face 32*a* to output the received light to the light-receiving element 22. The second light-guiding member 32 guides the light from the inner end face 32*b* to the outer end face 32*a* thereof, and the optical elements 21 and 22 get positioned facing the outer end faces 31*a* and 32*a* of the first light-guiding member 31 and the second light-guiding member 32 as the unit 1 is being installed in the image forming apparatus 1000. Thus, the developer amount detector 300 detects the toner amount (residual amount of the toner) based on differences of the length of the time period during which the light-receiving element 22 can detect the light and the timing thereof.

Figure 5:
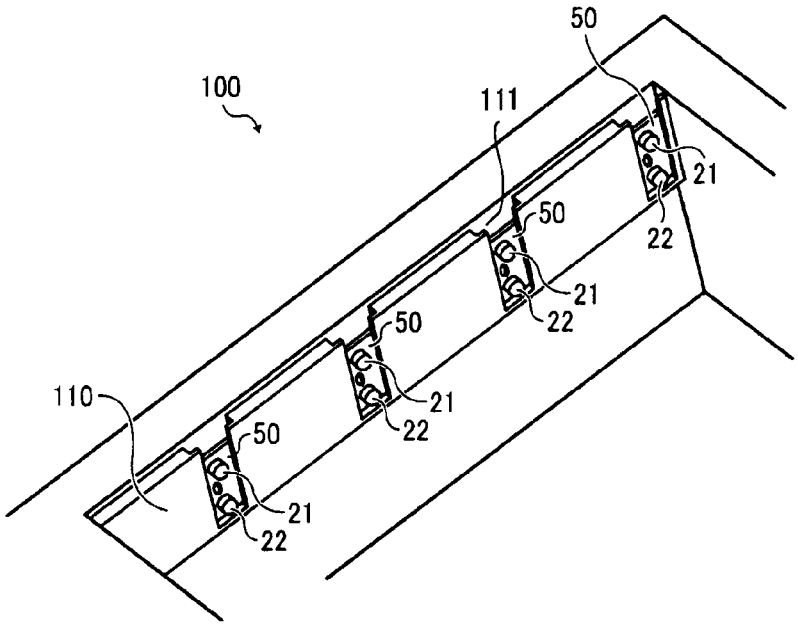
FIG. 5 is a schematic view illustrating an interior structure of an apparatus body of the image forming apparatus shown in FIG. 1.
Figure 6:
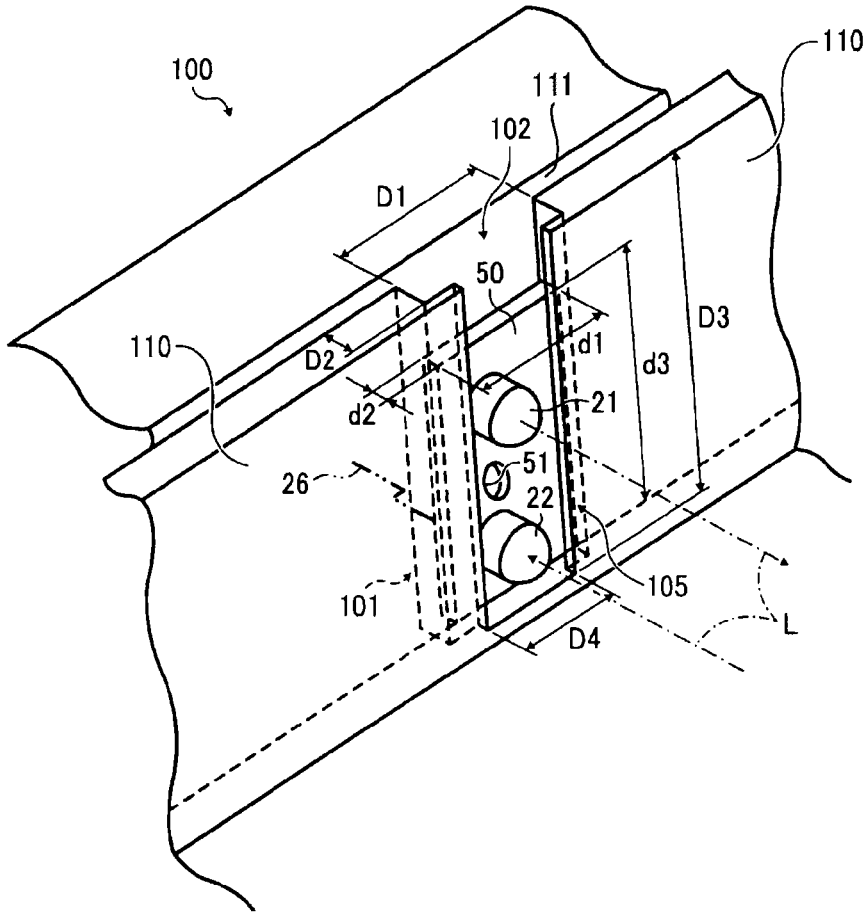
FIG. 6 is an expand view of a portion of a developer amount detector of the apparatus body shown in FIG. 5.

FIG. 5 is a schematic view illustrating an interior structure of the apparatus body 100 of the image forming apparatus 1000. FIG. 6 is an expand view of the main portion of the apparatus body 100 shown in FIG. 5. As illustrated in FIG. 5, in the apparatus body 100, the light-emitting elements 21 and the light-receiving elements 22 are provided as many as the process units 1. In the present embodiment, four light-emitting elements 21 and four light-receiving elements 22 are provided in the apparatus body 100. The four pairs of the light-emitting element 21 and the light-receiving element 22 are held by a planar holder 50 attached to the interior of the apparatus body 100.

As illustrated in FIG. 6, the holder 50 is held in a containing space 101 that is formed in the apparatus body 100. The containing space 101 formed in a vertical wall 110 of the apparatus body 100 of the image forming apparatus 1000 is defined by a bottom 101*a*, a back wall 111, and side faces in the vertical wall 110. An insertion opening 102 is formed in the containing space 101 so that the holder 50 is inserted into the containing space 101 from above through the insertion opening 102. The holder 50 inserted from the insertion opening 102 is stopped by contacting a bottom 101*a* of the containing space 101. An exposed opening 105 is formed in the containing space 101 so that the light-emitting element 21 and the light-receiving element 22 are exposed to the process unit 1 side. A lateral width D4 of the exposed opening 105 is set smaller than a lateral width d1 of the holder 50 so that the holder 50 cannot fall off the containing space 101. Conversely, a lateral width D1 of the containing space 101 is larger than the lateral width d1 of the holder 50, a vertical length D3 of the containing space 101 is larger than a vertical length d3 of the holder 50, and a thickness D2 of the containing space 101 is slightly larger than a thickness d2 of the holder 50.

As described above, the containing space 101 is formed larger than the holder 50 in the lateral direction and the vertical direction, and the holder 50 can be moved arbitrarily in the lateral direction and the vertical direction in the containing space 101. That is, the holder 50 can arbitrarily moved in a direction orthogonal to optical axes L of the light-emitting element 21 and the light-receiving element 22. Herein, the optical axes L of the light-emitting element 21 and the light-receiving element 22 indicate guide routes through which the light emitted from the light-emitting element 21 is guided to the light-receiving element 22 through the first and second light-guiding members 31 and 32.

With reference to FIG. 6, harnesses 26 to electrically connect the light-emitting element 21 and the light-receiving element 22 with an electronic element aggregation substrate (engine board) in the image forming apparatus 1000 are provided in a back face of the holder 50 positioned opposite to a face (exposed face) facing the process units 1. Herein, the harnesses 26 do not restrict the movement of the holder 50 in the direction orthogonal to the optical axes L in the holder 50. In addition, although four connector spaces for containing the four color harnesses 26 are normally required in the electronic element aggregation substrate, a relay substrate may be provided at an intermediate location for joining the four color harnesses together to reduce the size of the connector space, and the joined harnesses may be connected to single connector.

In the present embodiment, the vertical wall 110 enveloping the containing space 101 is formed of a thermoplastic resin so that the wall 110 cannot cause signal error even when the wall 110 contacts terminals such as the light-emitting element 21 and the light-receiving element 22 in the holder 50.

First Embodiment

Next, a positioning mechanism 300 to decide position of the light emitting element 21 and the light-receiving element 22 relative to the process unit 1 is described with reference to FIGS. 6 through 8.

Figure 7:
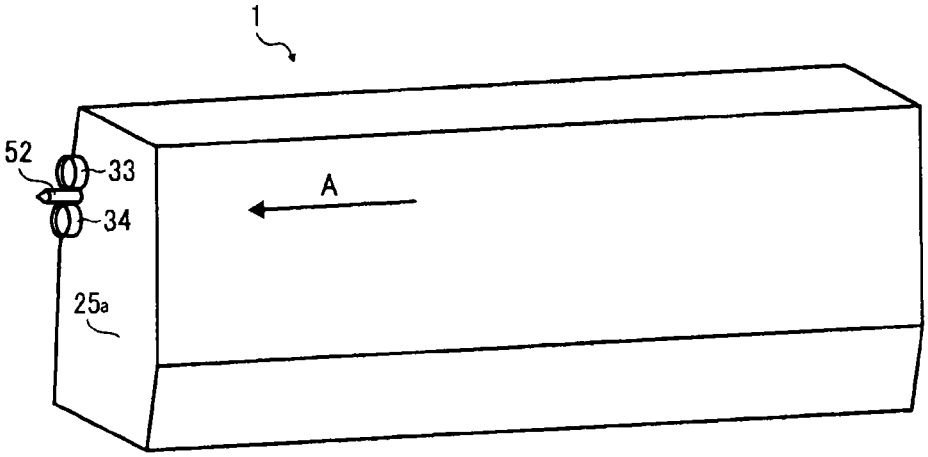
FIG. 7 is a schematic external view of a process unit shown in FIG. 2.

FIG. 7 is a schematic external view illustrating the process unit 1. FIG. 8 is an expanded view of a main portion of positioning in the process unit 1 shown in FIG. 7. With reference to FIG. 6, a circular hole 51 is penetrated in the holder 50. By contrast, with reference to FIG. 7, a pin projection 52 that is insertable into the hole 51 in the holder 50 is provided in the process unit 1. The hole 51 and the projection 52 constitute the positioning mechanism. The projection 52 projects from an end face 25*a* of the housing 25 in an installation direction in which the process unit 1 is installed in the apparatus body 100 of the image forming apparatus 1000, indicated by arrow A in FIG. 7. The end face 25*a* of the housing 25 faces the back wall 111 of the vertical wall 110.

Figure 8:
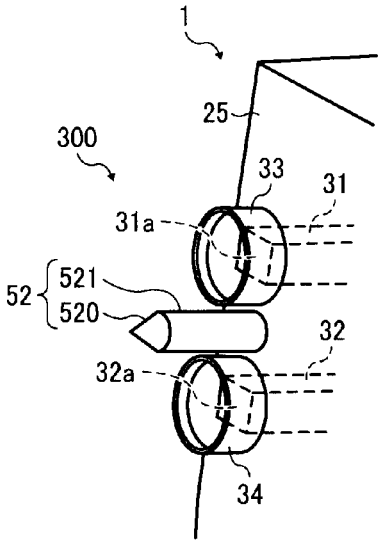
FIG. 8 is an expanded view of the portion of the developer amount detector in the process unit shown in FIG. 7.

With reference to FIG. 8, the projection 52 includes a conical guide portion 520 and a cylindrical positioning portion 521. The conical guide portion 520 that is narrower toward a tip (shaped tapered) so that the projection 52 is smoothly inserted into the hole 51. The cylindrical positioning portion 521 is used for deciding position of the light-emitting element 21 and the light-receiving element 22 relative to the light-guiding members 31 and 32 of the process unit 1. In the present embodiment, light-shielding covers 33 and 34 are provided in vicinities of the outer end faces 31*a* and 32*a* of the light-guiding members 31 and 32. The light-shielding covers 33 and 34 are hollow cylindrical members that are open in the direction of the optical axes L of the light-emitting element 21 and the light-receiving element 22, and respective internal edges of the light-shielding covers 33 and 34 are chamfered.

Next, with reference to FIGS. 9A through 9C, a positioning method of the light-emitting element 21 and the light-receiving element 22 is described below.

Figure 9A:
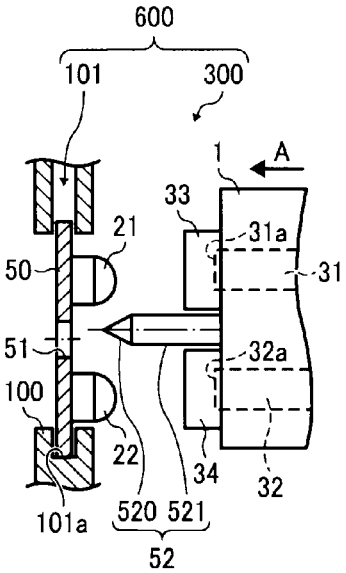
FIGS. 9A through 9C are diagrams illustrating a positioning of the process unit relative to a light-emitting element and a light-receiving element in the apparatus body.

Initially, as shown in FIG. 9A, the process unit 1 begins to be inserted into the apparatus body 100 in the insertion direction A. In an insertion start state shown in FIG. 9A, the projection 52 provided in the process unit 1 is not inserted into the hole 51 of the holder 50. In this state, the holder 50 is held by contacting the bottom 101*a* of the containing space 101 by gravity.

Figure 9B:
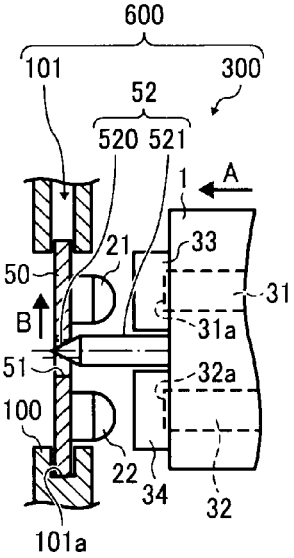

Then, as shown in FIG. 9B, the process unit 1 is further inserted into the apparatus body 100 in the insertion direction A, a near tip portion of the projection 52 contacts a rim of the hole 51 of the holder 50. At this time, the tapered guide portion 520 of the projection 52 contacts and slides along the rim of the hole 51, and the holder 50 is lifted upward, indicated by arrow B.

Figure 9C:
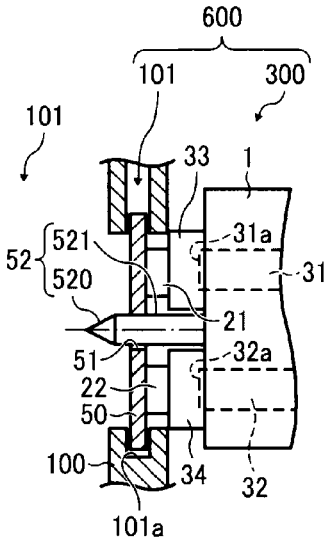

Then, as shown in FIG. 9C, when the installation of the process unit 1 within the apparatus body 100 is completed, the positioning portion 521 of the projection 52 is inserted into the hole 51, and the movement of the holder 50 in the direction orthogonal to the optical axes L is restricted. At this time, the light-emitting element 21 and the light-receiving element 22 are inserted into the light-shielding covers 33 and 34 without interference and then are positioned facing the respective outer end faces 31*a* and 32*a* of the light-guiding members 31 and 32.

As described above, in the present embodiment, as the process unit 1 is being installed in the apparatus body 100, the projection 52 is inserted into the hole 51, and the movement of the holder 50 in the direction orthogonal to the optical axes L is restricted. Therefore, the light-emitting element 21 and the light-receiving element 22 are accurately positioned to the respective outer end faces 31*a* and 32*a* of the light-guiding members 31 and 32. In other words, in the present embodiment, because the holder 50 is movable in the predetermined direction orthogonal to the optical axes L, even when the holder 50 is deviated relative to the process unit 1 in any direction orthogonal to the optical axes L, the positional deviation is corrected, and then accurate positioning can be performed. Thus, the toner amount can be detected with a high degree of accuracy.

In addition, when the positioning is completed, the light-shielding covers 33 and 34 are positioned in the vicinities of the light-emitting element 21 and the light-receiving element 22 respectively, unnecessary light divergence from the light-emitting element 21 and the unnecessary light incident to the light-receiving element can be prevented. More particularly, in a case in which the light-emitting element 21 is disposed adjacent to the light-receiving element 22 like the present configuration, the light-receiving element 22 can easily receive the light emitted from the adjacent light-emitting element 21, and detection error may occur. However, by providing the light-shielding covers 33 and 34, such detection error can be prevented. In addition, since a distance between the light-emitting element 21 and the photoreceptor 2 decreases as image forming apparatuses become more compact, there is a risk of adversely affecting the formation of latent image on the photoreceptor 2 when the light emitted from the light-emitting element 21 is strong. However, by providing the light-shielding cover 33 and 34, the unnecessary light irradiation to the photoreceptor 2 from the light-emitting element 21 can be prevented.

Conversely, when the process unit 1 is removed from the apparatus body 100, by moving the process unit 1 to a direction opposite to the insertion direction A, the projection 52 is released from the hole 51, and then the holder 50 is held by contacting the bottom 101*a* of the containing space 101.

Figure 10:
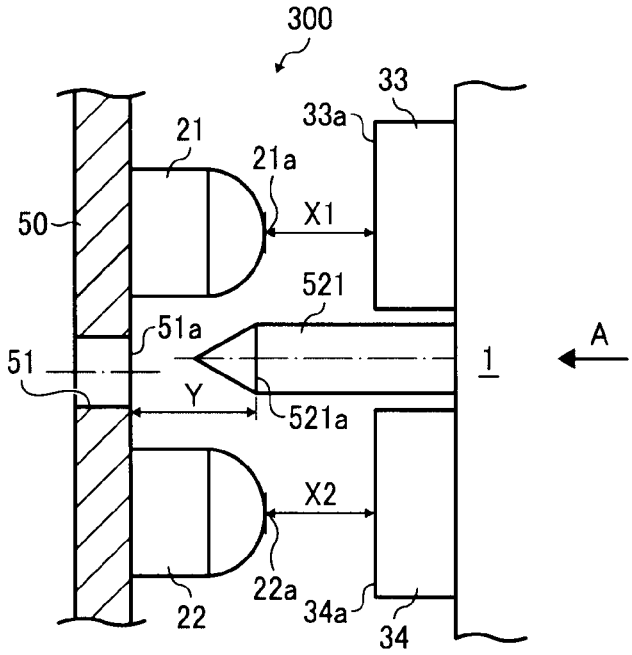
FIG. 10 is a diagram illustrating a distance between a tip of a positioning portion of a projection in the process unit and an entrance end of a hole in the apparatus body and distances between tips of shield covers of the process unit and the tips of the light-emitting element and the light-receiving element.
Figure 11:
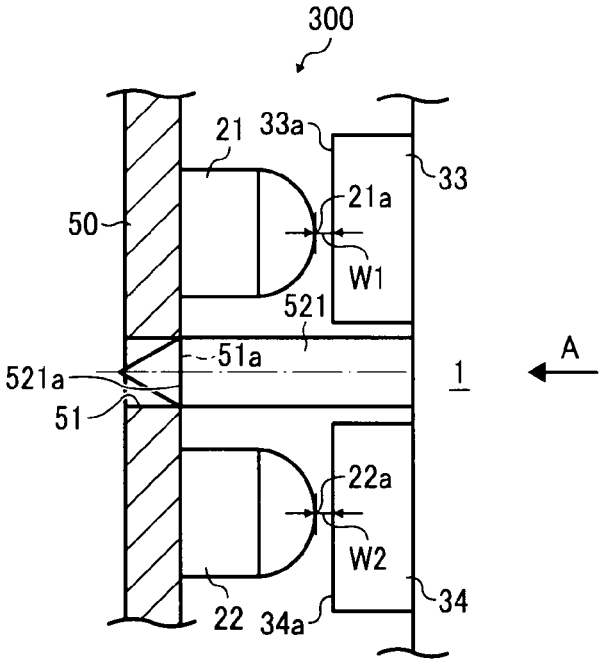
FIG. 11 is a diagram illustrating a state in which the tip of the positioning portion of the projection reaches the entrance end of the hole shown in FIG. 10.

As shown in FIGS. 10 and 11, it is preferable that distances X1 and X2 between tips 21*a* and 22*a* of the light-emitting element 21 and the light-receiving element 22 and tips 33*a* and 34*a* of the corresponding light-shielding cover 33 and 34 be greater than a distance Y between an entrance end 51*a* of the hole 51 and a tip 521*a* of the positioning portion 521 of the projection 52 in the insertion direction A of the process unit 1. By setting this size configuration, as shown in FIG. 11, in a state in which the tip 521*a* of the positioning portion 521 reaches the entrance end 51*a* of the hole 51, predetermined distances W1 and W2 can be formed between the tips 21*a* and 22*a* of the light-emitting element 21 and the light-receiving element 22 and the light-shielding covers 33 and 34. Thus, when the process unit 1 is being installed, the tip 521*a* of the positioning portion 521 reaches the entrance end 51*a* of the hole 51 and positioning is performed in the projection 52 and the hole 51, before the tips 33*a* and 34*a* of the light-shielding covers 33 and 34 reach the positions of the tips 21*a* and 22*a* of the light-emitting element 21 and the light-receiving element 22.

In other words, a positioning structure 600 positions the process unit 1 within the image forming apparatus 1000. The positioning structure 600 includes the above-described optical elements 21 and 22, the light-guiding members 31 and 32, the containing space 101, the planar holder 50, the projection 52, and the hole 51. The holder 50 is held by the bottom 101*a* of the containing space 101 in a state in which the unit 1 is not installed in the image forming apparatus 1000. The holder 50 is moved by inserting the projection 52 into the hole 51 when the unit 1 is being installed in the image forming apparatus 1000. The holder 50 is held by the projection 52 that is fitted into the hole 51 to restrict the movement of the holder 50 in the direction orthogonal to the optical axes L of the optical elements 21 and 22 relative to the unit 1 in a state in which the unit 1 is installed in the image forming apparatus 1000.

Therefore, the interference between the light-shielding covers 33 and 34 and the light-emitting element 21 and the light-receiving element 22 can be reliably prevented, and the damage of the light-emitting element 21 and the light-receiving element 22 can be prevented.

Second Embodiment

Figure 12:
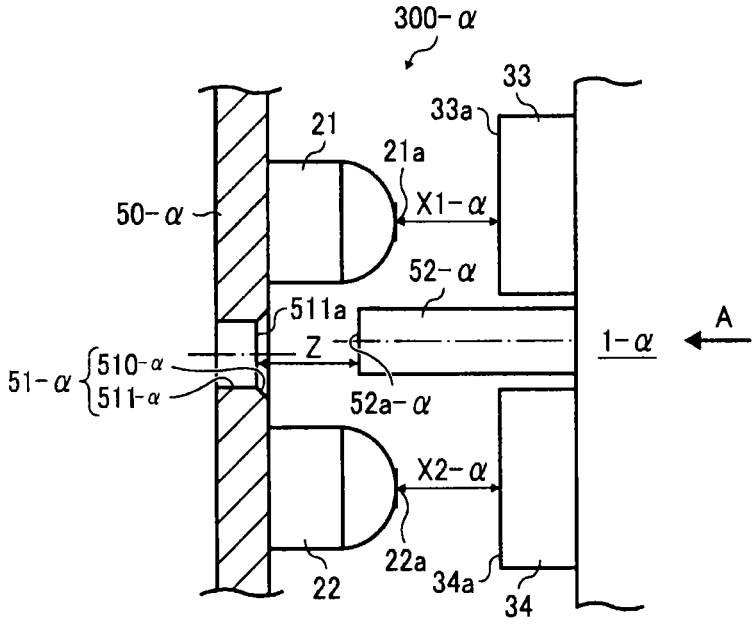
FIG. 12 is a diagram illustrating a distance between a tip of a projection in the process unit and an entrance end of a hole in the apparatus body and distances between tips of shield covers of the process unit and the tips of the light-emitting element and a light-receiving element according to a second embodiment.
Figure 13:
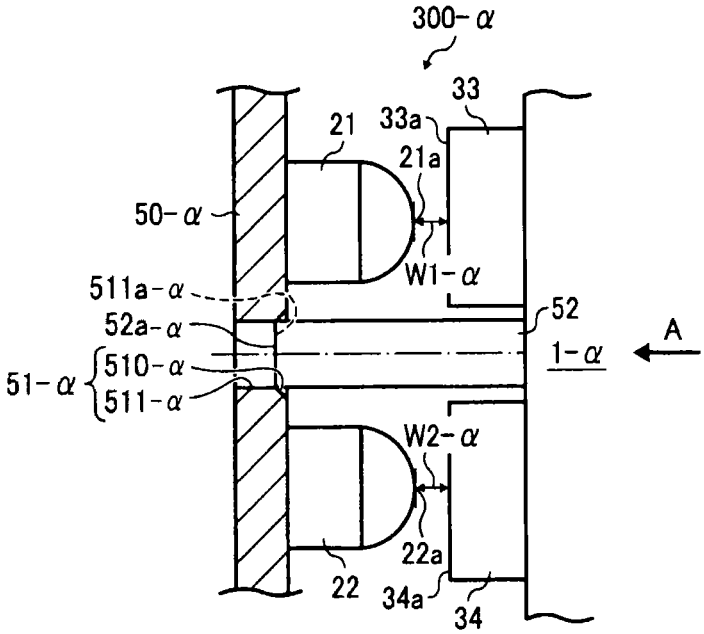
FIG. 13 is a diagram illustrating a state in which the tip of the positioning portion of the projection reaches the entrance end of the hole shown in FIG. 12.

Next, a developer amount detector 300-α according to a second embodiment is described below with reference to FIGS. 12 and 13. As illustrated in FIGS. 12 and 13, a guide portion 510-α can be provided in an entrance side of a hole 51-α in a holder 50-α. In the present embodiment, since the guide portion 510-α forms expanding to taper shape toward the entrance side, that is, the guide portion 510-α is a chamfered rim in the entrance side of the hole 51-α, a cylindrical projection 52-α can be smoothly inserted into the hole 51-α. The hole 51-α further includes a positioning space 511-α that extends straight in the insertion direction. By inserting the cylindrical projection 52-α into the positioning space 511-α of the hole 51-α, the positions of the light-emitting element 21 and the light-receiving element 22 are determined.

As illustrated in FIG. 12, it is preferable that a distance X1-α between the tip 21*a* of the light-emitting element 21 and the tip 33*a* of the light-shielding cover 33 and a distance X2-α between the tip 22*a* of the light-receiving element 22 and the tip 34*a* of the light-shielding cover 34 be set larger than a distance Z between an entrance end 511*a*-α of the positioning space 511-α and a tip 52*a*-α of the projection 52-α. With this configuration, as illustrated in FIG. 13, in a state in which the tip 52*a*-α of the projection 52-α reaches the entrance end 511*a*-α of the positioning space 511-α, a distance W1-α between the tip 21*a* of the light-emitting element 21 and a distance W2-α between the tip 22*a* of the light-receiving element 22 can be provided. Therefore, similar to the first embodiment, in the present embodiment, the interference between the light-shielding cover 33 and the light-emitting element 21 and between the light-shielding cover 34 and the light-receiving element 22 can be reliably prevented.

Third Embodiment

A developer amount detector 300-β according to a third embodiment is described below. In the third embodiment shown in FIGS. 14A through 14C, a projection 52-β is provided in a holder 50-β, and a hole 51-β is formed in a process unit 1-β. That is, in the present embodiment, objections (holder 50-β and the process unit 1-β) in which one of the projection 52-β and the hole 51-β is provided are opposite to the above-described first and second embodiment. Other configuration is similar to the first embodiment.

Figure 14A:
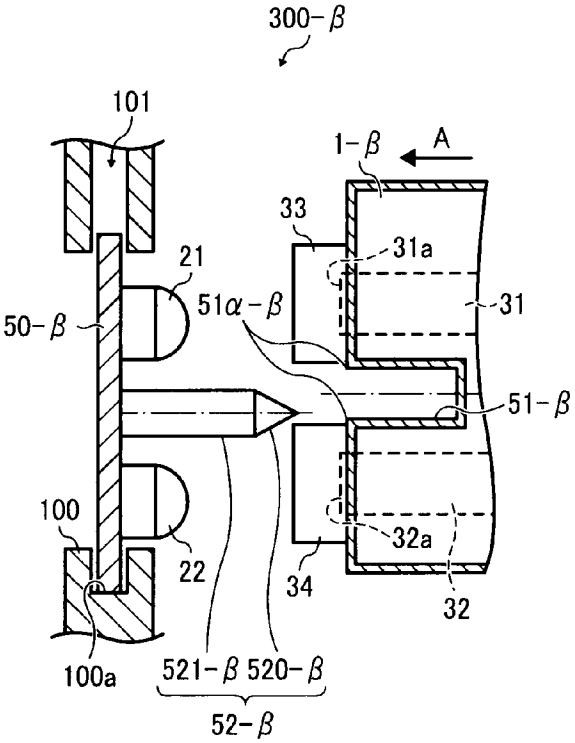
FIG. 14A through 14C are diagrams illustrating a process of installing the process unit in the apparatus body in a configuration in which a projection is provided in a holder and a hole is formed in the process unit according to a third embodiment.

With this configuration, as illustrated in FIG. 14A, before the projection 52-β is inserted into the hole 51-β, the holder 50-β is held by contacting the bottom 101*a* of the containing space 101 by gravity.

Figure 14B:
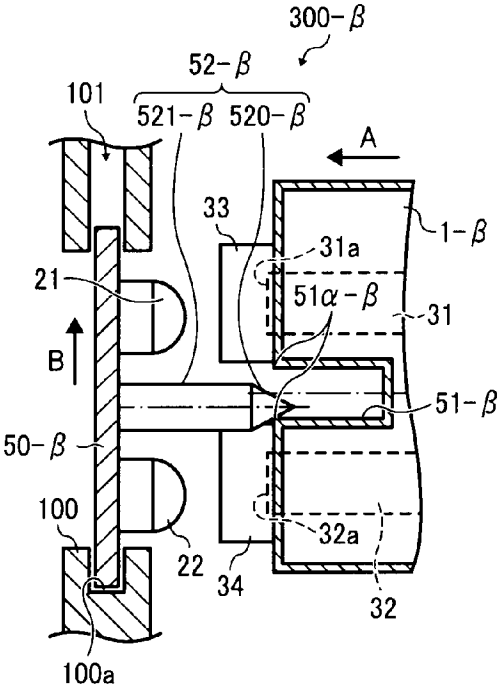

Then, as illustrated in FIG. 14B, in installation (insertion) of the process unit 1-β in the apparatus body 100, when a rim 51*a*-β of the hole 51-β contacts a near tip portion of the projection 52-β, a tapered guiding portion 520-β of the projection 52-β contacts and slides on the rim 51*a*-β of the hole 51-β. Thus, the projection 52-β is guided to the hole 51-β, and the holder 50-β is lifted in a direction indicated by arrow B.

Figure 14C:
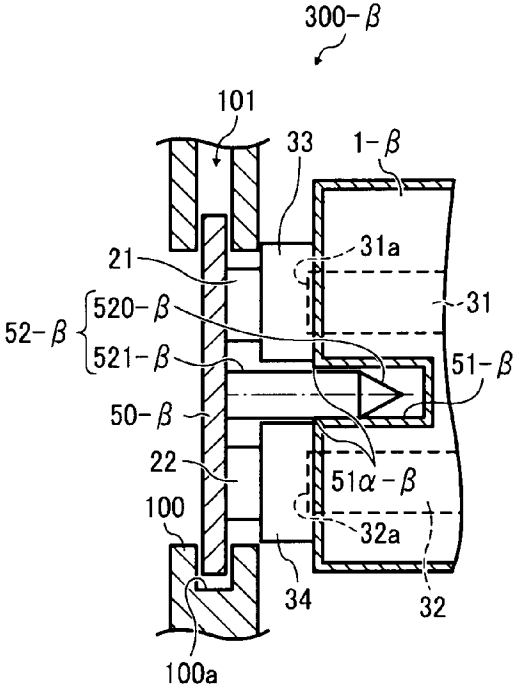

Subsequently, as illustrated in FIG. 14C, after installation of the process unit 1-β in the apparatus body 100 is completed and a positioning portion 521-β of the projection 52-β is inserted into the hole 51-β, the movement of the holder 50-β in a direction orthogonal to the optical axes L of the optical elements 21 and 22 in the holder 50-β is restricted.

Thus, similarly to the above-described embodiments, the light-emitting element 21 and the light-receiving element 22 are accurately positioned to the respective outer end faces 31*a* and 32*a* of the light-guiding members 31 and 32, and the amount of the toner can be detected with high degree of accuracy. In addition, in a state in which the positioning is completed, by inserting the light-emitting element 21 and the light-receiving element 22 into the light-shielding covers 33 and 34, unnecessary light divergence and light irradiation can be prevented.

In the present embodiment shown in FIGS. 14A through 14C, the projection 52-β is provided not detachably-installable process unit 1-β but the holder 50-β, the projection 52-β is less likely to receive damage directly and be broken. By contrast, unlike the third embodiment, in a configuration in which the projection 52 is provided in the process unit 1, because the hole 51 is not provided in the process unit 1, reducing the capacity amount of the developer in the process unit 1 can be prevented, that is, the capacity amount of the developer can be greater.

Fourth Embodiment

Next, a developer amount detector 300-γ according to a fourth embodiment is described below. In the fourth embodiment shown in FIGS. 15A through 15C, light-shielding covers 33-γ and 34-γ are provided in a holder 50-γ. With this configuration, regardless of installation of a process unit 1-γ, the light-emitting element 21 and the light-receiving element 22 are always surrounded by the light-shielding covers 33-γ and 34-γ. Other configuration in the present embodiment is similar to the configuration of the first embodiment shown in FIG. 9.

Figure 15A:
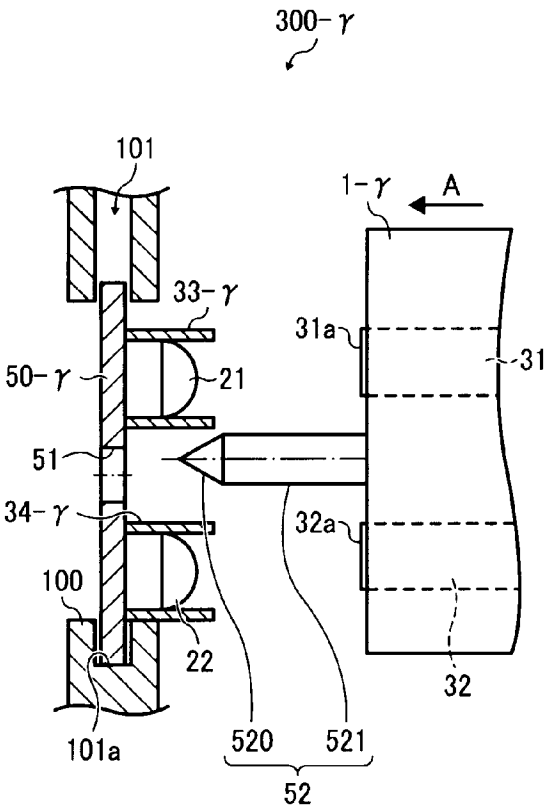
FIG. 15A through 15C are diagrams illustrating a process of installing the process unit in the apparatus body in a configuration in which a shield cover is provided in a holder according to a fourth embodiment.
Figure 15B:
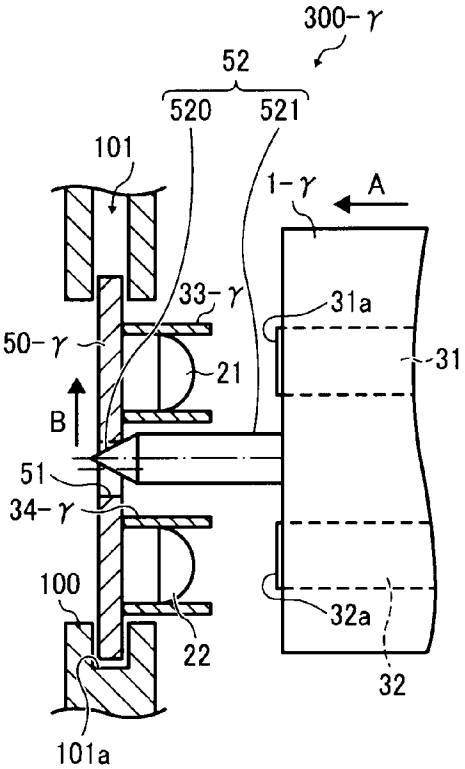
Figure 15C:
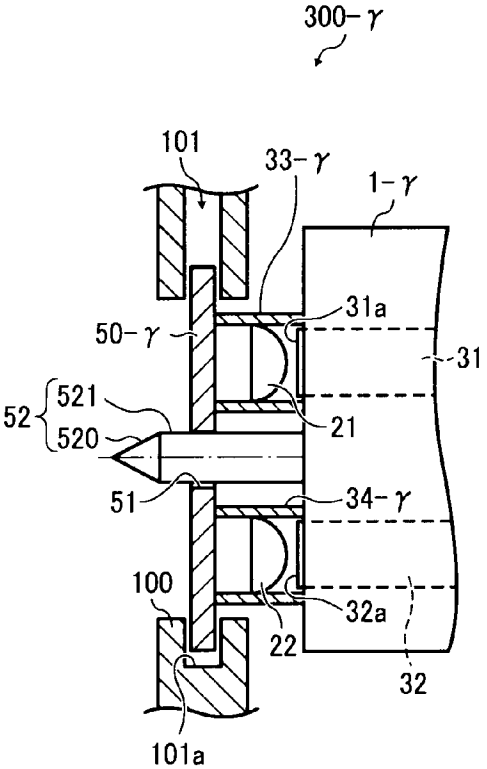

In the fourth embodiment, when the process unit 1-γ is inserted into the apparatus body 100 in order of FIGS. 15A, 15B, to 15C, by inserting the projection 52 into the hole 51, the movement of the holder 50-γ in a direction orthogonal to the optical axes L is restricted. Thus, the light-emitting element 21, the light-receiving element 22, and the light-shielding covers 33-γ and 34-γ are positioned facing to the outer end faces 31*a* and 32*a* of the light-guiding members 31 and 32. It is to be noted that the positioning of the holder 50-γ with insertion of the projection 52 into the hole 51 is similar to the first embodiment, and the detailed description there of is omitted.

Fifth Embodiment

Figure 16:
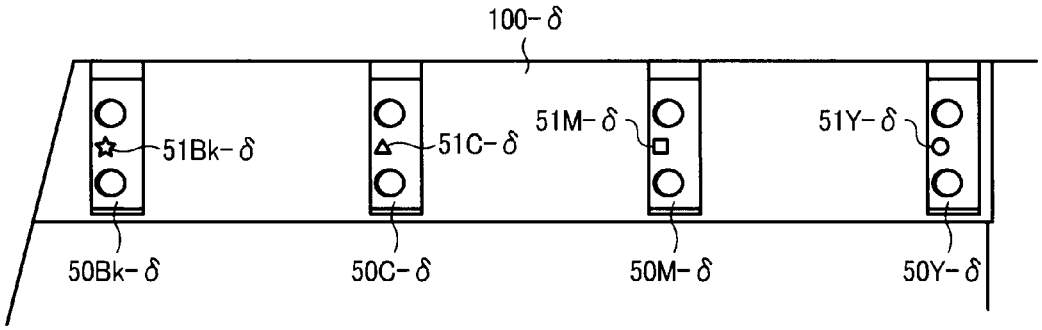
FIG. 16 is a diagram illustrating holders in the image forming apparatus in which shapes of holes are different respectively according to a fifth embodiment.

Although the holes 51 in the respective holders 50 in the apparatus body 100 are identical shapes in the above-described embodiments with reference to FIG. 5, in a fifth embodiment show in FIG. 16, the shapes of holes 51-δ in a holder 50-δ are different respectively. With this configuration, although figure is omitted, respective projections 52Y-δ, 52M-δ, 52C-δ, and 52Bk-δ are difference formations in response to the shapes of corresponding holes 51Y-δ, 51M-δ, 51C-δ, and 51Bk-δ. That is, the projections 52-δ and the holes 51-δ are shaped differently so that each of the holder 50Y-δ, 50M-δ, 50C-δ, and 50Bk-δ can engage only the corresponding toner color of the process unit 1 among the process units 1Y-δ, 1M-δ, 1C-δ, and 1Bk-δ that include the developer containers 43Y, 43M, 43C, and 43Bk respectively. Thus, because the shapes of the projections 52-δ and the holes 51-δ are different respectively, when the process unit 1Y-δ is installed in any of the incorrect holder 50M-δ, 50C-δ, or 50Bk-δ, the projection 52Y-δ cannot be inserted into any of the incorrect hole 51M-δ, 51C-δ, or 51Bk-δ. Therefore, the setting error (color discrimination) of the process unit 1-δ relative to the apparatus body 100 can be prevented. In addition, when the process unit 1Y-δ is tried to be installed in any of the incorrect holder 50M-δ, 50C-δ, or 50Bk-δ, because the projection 52Y-δ is not inserted into any of the incorrect hole 51M-δ, 51C-δ, or 51Bk-δ, the process unit 1Y-δ may be projected outside from the apparatus body 100, and the front door 200 shown in FIG. 2 may not be closed at this time.

Sixth Embodiment

Figure 17:
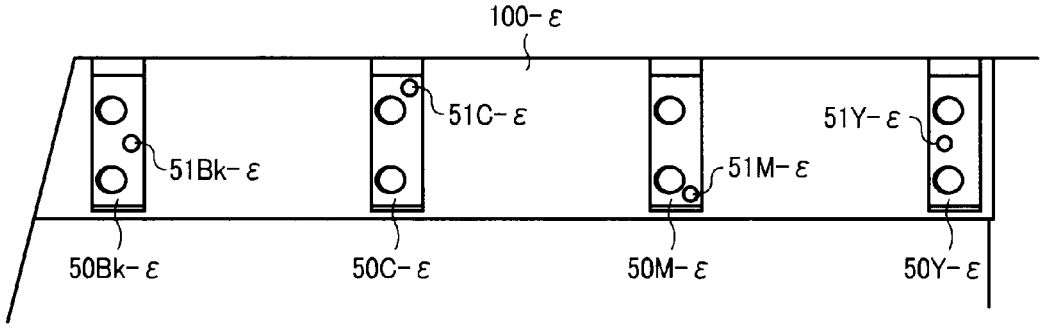
FIG. 17 is a diagram illustrating holders in the image forming apparatus in which positions of holes are different respectively according to a sixth embodiment.

In the present embodiment, in order to prevent the setting error of the process unit 1, arrangement of holes 51-ϵ in holders 50-ϵ and arrangement of corresponding projections 52-ϵ in process units 1-ϵ are provided at different positions thereamong, as shown in FIG. 17.

Alternatively, the shapes or arrangement of the projections 52-ϵ and the hole 51-ϵ may also be set differ with respect to each color in the process units 1-ϵ in a configuration in which the projection 52-β is provided in the holder 50-β and the hole 51-β is provided in the process unit 1-β. (see FIGS. 14A through 14C) With this configuration, similarly to above, the setting error about the color discrimination of the process unit 1 in the apparatus body 100 can be prevented.

Further alternatively, the shapes or arrangement of the projections 52-ϵ and the corresponding holes 51-ϵ may be differ for different models of the image forming apparatuses to prevent a wrong type of process unit 1 from being attached to the holder 50 of the image forming apparatus 1000. With this configuration, the process unit 1 cannot be installed in the image forming apparatus 1000 in which the shape or arrangement of the projection 52-ϵ and the hole 51-ϵ are different. That is, the processes unit 1 can be distinguished from other types of the process units such as those sold by other companies, or dedicated for other types of image forming apparatuses.

Seventh Embodiment

Figure 18:
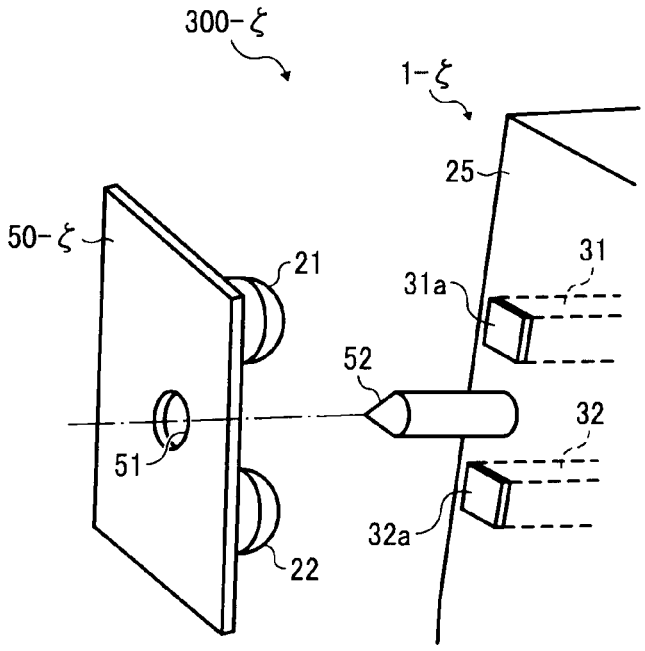
FIG. 18 is a diagram illustrating a developer amount detector of the process unit and the apparatus body in which a shield cover is not provided according to a seventh embodiment.

FIG. 18 shows a configuration in which the light-shielding cover is not provided in a developer amount detector 300-ζ; The configuration in which the projection 52 is inserted into the hole 51 in the installation of the process unit 1 in the apparatus body 100 can be adapted to the configuration in which the light-shielding cover is not provided as shown in FIG. 18. Although the projection 52 is provided in the process unit 1 and the hole 51 is formed in the holder 50-ζ shown in FIG. 18, the light-shielding cover may not be provided in a configuration in which the hole 51-β is formed in the process unit 1-β, and the projection 52-β is provided in the holder 50-β (see FIGS. 14A through 14C).

In the above-described first to seventh embodiments, in order to decide the position of the holder 50, one axis engagement in which the lateral cylindrical projection 52 is inserted into the circular hole 51. Therefore, the holder 50 may rotate (pivot) around the projection 52 (in other words, the hole 51). Accordingly, in the above-described embodiments, if the holder 50 is rotated, the positions of the light-emitting element 21 and the light-receiving element 22 may be deviated relative to the light-guiding members 31 and 32. In an effort to counteract this problem, a rotary restriction mechanism to restrict rotation of the holder 50 may be provided as described below.

Eighth Embodiment

Figure 19:
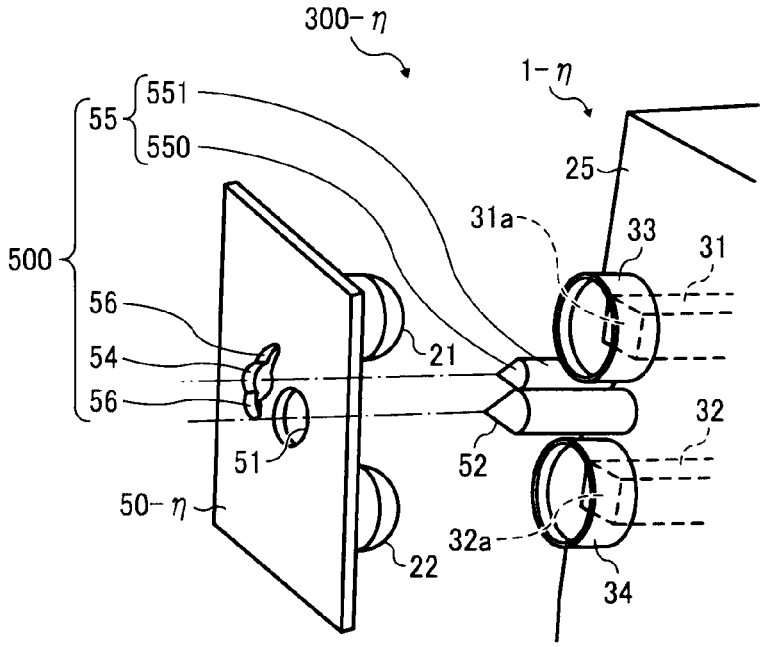
FIG. 19 is a diagram illustrating a developer amount detector of the process unit and the apparatus body in which a rotary restriction mechanism is provided according to an eighth embodiment.

Next, a developer amount detector 300-η according to an eighth embodiment is described below with reference to FIGS. 19 through 21B. The developer amount detector 300-η further includes a rotary restriction mechanism 500. In FIG. 19, the rotary restriction mechanism 500 is constituted by an engagement protrusion 55 provided in a process unit 1-η and an engagement hole 54 formed in a holder 50-η and two grooves 56 that are connected with the engagement hole 54.

The engagement protrusion 55 is constituted by a pin that is shorter than the projection 52. Similarly to the projection 52, the engagement protrusion 55 includes a conical guide portion 550 formed taper shape and a cylindrical positioning portion 551 to perform positioning.

In the holder 50-η, the engagement hole 54 is a circular hole whose diameter is almost identical to an external diameter of the positioning portion 551 of the engagement protrusion 55. The two grooves 56 are provided both vertical sides of the engagement hole 54. Herein, although the engagement hole 54 and the grooves 56 penetrate through the holder 50-η shown in FIG. 19, the engagement hole 54 and the grooves 56 may be formed by bottomed cylindrical hollows or recessed grooves that do not penetrate through the holder 50.

Figure 20:
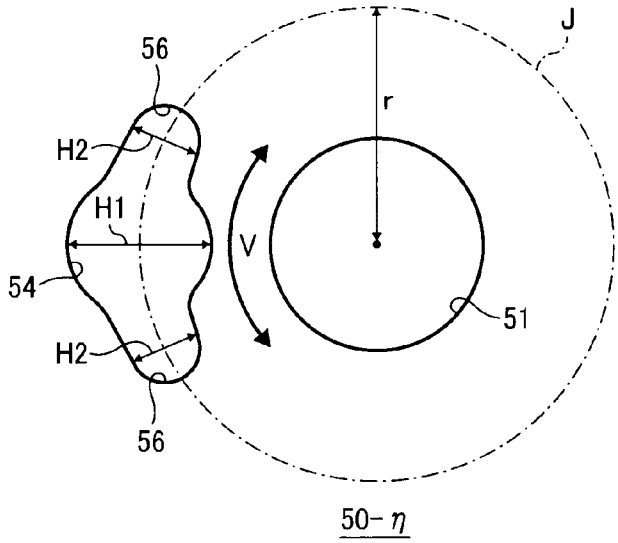
FIG. 20 is an expanded diagram illustrating an engagement hole and a groove constituting the rotary restriction mechanism shown in FIG. 19.

As illustrated in FIG. 20, the grooves 56 are formed on a circle J of radius r that is concentric with the hole 51. In other words, the grooves 56 extend in a rotary direction V in which the holder 50-η rotates around the projection 52 that is inserted into the hole 51. In addition, opening widths H2 of the respective grooves 56 are smaller than an opening width (diameter) H1 of the engagement hole 54, and the opening widths H2 are progressively increased toward the engagement hole 54.

Next, positioning operation of the holder 50-η in a direction in which the holder 50-η is rotated around the projection 52 (hereinafter "rotary direction) is described below, with reference to FIGS. 19 through 21B. In FIG. 19, when the process unit 1-η is moved closer to the holder 50-η that is attached to the apparatus body 100, initially, the projection 52 is inserted into the hole 51, and then the engagement protrusion 55 is inserted into the engagement hole 54. After that, the projection 52 is engaged with the hole 51, and the engagement protrusion 55 is engaged with the engagement hole 54. With this engagement, the holder 50-η and the process unit 1-η are engaged with each other by using two shafts of the projection 52 and the engagement protrusion 55. Therefore, to rotate the holder 50 around the projection 52 can be prevented.

Figure 21A:
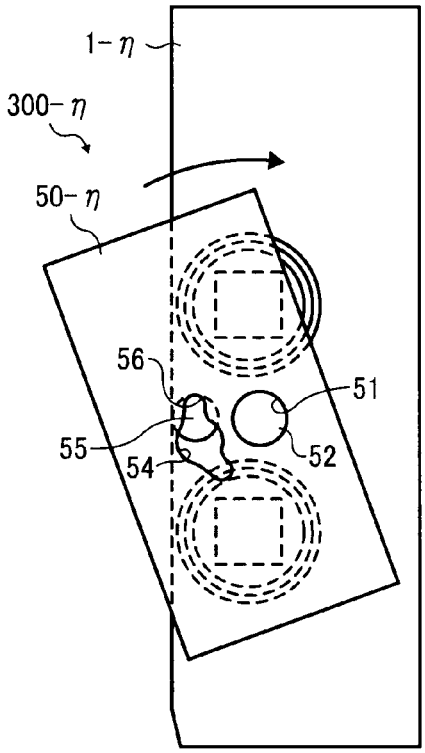
FIGS. 21A and 21B are diagrams illustrating positioning operation of the holder relative to the process unit in a direction in which the holder is rotated shown in FIG. 19.
Figure 21B:
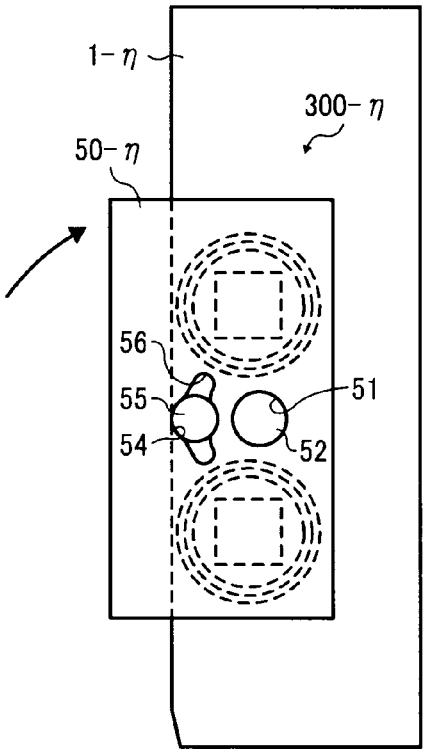

In one example, as illustrated in FIG. 21A, when the positioning of the holder 50-η is performed, the holder 50-η may be deviated in a direction in which the holder 50-η rotates around the hole 51. In this state, when the process unit 1-η is moved closer to the holder 50-η, although the projection 52 is inserted into the hole 51, the engagement protrusion 55 is inserted into not the engagement hole 54 but the grooves 56. In a state shown in FIG. 14A, only a tip (conical guide portion 550) that is tapered shape of the engagement protrusion 55 is inserted into one of the grooves 56. Then, when the process unit 1-η is further moved closer to the holder 50-η, the guide portion 550 of the engagement protrusion 55 is moved to a direction in which the opening width H2 of the grooves are gradually wider, that is, the engagement protrusion 55 is moved toward the engagement hole 54. With this effect, the holder 50-η is rotated in a direction indicated by arrow shown in FIGS. 21A and 21B, and position deviation in the rotary direction can be corrected. Then, as shown in FIG. 21B, when the engagement protrusion 55 reaches the engagement hole 54, the engagement protrusion 55 is inserted into the engagement hole 54, and the engagement protrusion 55 and the engagement hole 54 are engaged. Thus, the rotation of the holder 50-η is restricted, and the holder 50-η is held at a predetermined position.

In the eighth embodiment shown in FIGS. 19 through 21B, using a simple configuration, the position deviation of the holder 50-η in the rotary direction is corrected, and the holder 50-η is kept at the predetermined position. More specifically, the grooves 56 guide a tip of the engagement protrusion 55 to the engagement hole 54 as the unit 1 is being installed in the image forming apparatus 1000 when the engagement protrusion 55 is deviated from the engagement hole 54 after the projection 52 is inserted into the hole 51. Therefore, the positioning the light-emitting element 21 and the light-receiving element 22 can be accurately determined, and the detection accuracy of the toner amount can be more improved.

It is to be noted that in FIG. 21A, although a case in which the engagement protrusion 55 is inserted into an upper groove 56 is described above, when the holder 50-η is deviated in a direction opposite to the case shown in FIG. 21A, the engagement protrusion 55 is inserted into a lower groove 56. In this case, because the engagement protrusion 55 is guided to the engagement hole 54 by the lower groove 56 owing to similar function as described above, the position offset of the holder 50-η in the rotary direction is corrected.

Alternatively, the engagement protrusion 55 may be provided in the holder 50, and the engagement hole 54 and the grooves 56 may be provided in the process unit 1 side. Similar to the projection 52 and the hole 51, advantage is different in the respective cases, it can be select whether the engagement protrusion 55 and the engagement hole 54 are provided in the process unit 1 or the holder 50 in view of foregoing the advantage in the respective cases, similar to the projection 52 and the hole 51. That is, when the engagement protrusion 55 is provided in the holder 50, the engagement protrusion 55 is less likely to receive damage directly and be broken, compared to the configuration in which the engagement protrusion 55 is provided to the process unit 1. By contrast, when the engagement protrusion 55 is provided in the process unit 1, because the engagement hole 54 is not formed in the process unit 1, reducing the capacity amount of the developer in the process unit 1 can be prevented, that is, the capacity amount of the developer can be greater.

Variations

In addition, the above-described developer amount detector may be used for units that are removably installable in the apparatus body of the image forming apparatus, instead of the above-described process units. For example, the above-described developer amount detector can be used for a developer container including a developer containing portion that is installable in the image forming apparatus body, and for a development device including a developer containing portion and a development member such as development roller, which is installable in the image forming apparatus. In addition, the above-described developer amount detector can be used for a waste-toner container that is removably installable in the image forming apparatus. In those cases, the similar effects as those in the above-described embodiments can be attained.

It is to be noted that, although, in first embodiment through the eighth embodiments, the process units 1Y, 1M, 1C, and 1Bk contain only toner, when an image forming apparatus supplies two-component developer formed of toner and carrier, the process units 1Y, 1M, 1C, and 1Bk can also contain two-component developer. In this case, the similar effects as those in the above-described embodiments can be attained. Alternatively, the above-described developer amount detector may detect liquid ink instead of power type developer.

In addition, although the above-described developer amount detector is installed in a tandem-type color laser printer in which the images formed on the four photoreceptors are one transferred to the recording medium via the intermediate transfer belt 8 as shown in FIG. 1, the above-described developer amount detector may be also installed in the image forming apparatus, such as a copier, a printer, a facsimile machine, a plotter, or a multifunction machine capable of at least two of these functions.

For example, the above-described developer amount detector may be installed in an image forming apparatus in which the image is formed by contacting four development devices with single photoreceptor in series. Especially in this case, when the development devices contact with and separate from the photoreceptor, the holder that holds the light-emitting element and the light-receiving element can move following to the development device by using the above-described developer amount detector for a positioning structure of the light-emitting element and the light-receiving element. Accordingly, position deviation of the light-emitting element and the light-receiving element relative to the corresponding development device caused by the contact-separate operation of the development device with the photoreceptor can be prevented.

In addition, the material and shape of the developer amount detector are not limited to the above-described embodiments, and various modifications and improvements in the material and shape of the developer amount detector are possible without departing from the spirit and scope of the present invention.

As described above, the optical elements to detect the amount of the developer can be accurately positioned relative to the removably-installable units in the apparatus body of the image forming apparatus by using simple configuration. More specifically, the optical elements can be positioned relative to the removably-installable units with high degree of accuracy only by holding the optical elements in the movable holder that can move in a predetermined orthogonal to the optical axes of the optical elements and positioning the holder relative to the units by the positioning mechanisms including projections and holes. Accordingly, the number of components can be streamlined, and the device can be made more compact, thereby reducing cost.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developer amount detector for detecting an amount of developer contained in a developer container in a unit that is removably installable in an image forming apparatus, the developer amount detector comprising:

optical elements having a light-emitting element to emit light and a light-receiving element to receive the light for detecting the amount of the developer in the unit;

light-guiding members, provided in the unit, to guide the light emitted from the light-emitting element to the light-receiving element;

a holder, held in the image forming apparatus, to hold the optical elements, movable in a direction orthogonal to optical axes of the optical elements as the unit is being installed in the image forming apparatus; and a positioning mechanism to position the unit within the image forming apparatus by restricting movement of the holder in the direction orthogonal to the optical axes of the optical elements relative to the unit in a state in which the unit is installed in the image forming apparatus, wherein the positioning mechanism is positioned between an end wall of the unit along a direction the unit is installed and a wall within the image forming apparatus, wherein the unit is installed in the image forming apparatus and the end wall faces the wall within the image forming apparatus along the direction the unit is installed.

2. The developer amount detector according to claim 1, wherein a containing space whose size is larger than the holder in the direction orthogonal to the optical axes of the optical elements is formed in the image forming apparatus, and the holder is contained in the containing space.

3. The developer amount detector according to claim 1, wherein the light-guiding members comprise:

a first light-guiding member having an outer end face facing the light emitted from the light-emitting element and an inner end face positioned inside the unit to guide the light from the outer end face to the inner end face thereof; and a second light-guiding member having an inner end face facing the inner end face of the first light-guiding member in the unit to receive the light from the inner end face of the first light-guide member through the developer in the unit and an outer end face to output the received light to the light-receiving element, the second light-guiding member guiding the light from the inner end face to the outer end face thereof, and the optical elements get positioned facing the outer end faces of the first light-guiding member and the second light-guiding member as the unit is being installed in the image forming apparatus.

4. The developer amount detector according to claim 1, wherein the positioning mechanism comprises:

a projection formed in one of the holder and the unit; and a hole formed in the other of the holder and the unit to accommodate the projection as the unit is being installed in the image forming apparatus.

5. The developer amount detector according to claim 4, wherein the projection is formed in the unit and the hole is formed in the holder.

6. The developer amount detector according to claim 4, wherein the projection is formed in the holder and the hole is formed in the unit.

7. The developer amount detector according to claim 4, wherein at least one of the projection and the hole comprises a guide portion to guide the projection to the hole, the guide portion of the projection comprising a conical tip, the guide portion of the hole comprising a chamfered rim.

8. The developer amount detector according to claim 4, further comprising:

a rotary restriction mechanism to restrict rotation of the holder around the projection relative to the unit in a state in which the projection is inserted into the hole.

9. The developer amount detector according to claim 8, wherein the rotary restriction mechanism comprises:

an engagement protrusion formed in one of the holder and the unit; and an engagement hole formed in the other of the holder and the unit to accommodate the engagement protrusion as the unit is being installed in the image forming apparatus.

10. The developer amount detector according to claim 9, further comprising two grooves formed adjacent to the engagement hole and extending in a direction in which the holder rotates around the projection, wherein the grooves guide a tip of the engagement protrusion to the engagement hole as the unit is being installed in the image forming apparatus when the engagement protrusion is deviated from the engagement hole after the projection is inserted into the hole.

11. The developer amount detector according to claim 1, further comprising hollow cylindrical light-shielding covers open in directions of the optical axes of the optical elements, provided in vicinities of outer end faces of the light-guiding members in the unit, wherein the light-shielding covers cover vicinities of the respective optical elements as the unit is being installed in the image forming apparatus.

12. The developer amount detector according to claim 1, further comprising hollow cylindrical light-shielding covers open in directions of the optical axes of the optical elements, provided in vicinities of the optical elements in the holder to cover the vicinities of the respective optical elements.

13. An image forming apparatus comprising:

a latent image carrier to carry a latent image;

a unit removably installable in the image forming apparatus, having a developer container;

a developer amount detector to detect an amount of developer contained in the developer container in the unit, the developer amount detector comprising:

optical elements having a light-emitting element to emit light and a light-receiving element to receive the light for detecting the amount of the developer in the unit;

light-guiding members, provided in the unit, to guide the light emitted from the light-emitting element to the light-receiving element;

a holder, held in the image forming apparatus, to hold the optical elements, movable in a direction orthogonal to optical axes of the optical elements as the unit is being installed in the image forming apparatus; and a positioning mechanism to position the unit within the image forming apparatus by restricting movement of the holder in the direction orthogonal to the optical axes of the optical elements relative to the unit in a state in which the unit is installed in the image forming apparatus, wherein the positioning mechanism is positioned between an end wall of the unit along a direction the unit is installed and a wall within the image forming apparatus, wherein the unit is installed in the image forming apparatus and the end wall faces the wall within the image forming apparatus along the direction the unit is installed.

14. The image forming apparatus according to claim 13, further comprising additional multiple units including developer containers to store developer of different colors, respectively, wherein the positioning mechanism comprises a projection formed in one of the holder and the unit and a corresponding hole formed in the other of the holder and the unit to accommodate the projection as the unit is being installed in the image forming apparatus, and shapes of the projections and the corresponding holes are different for each of the multiple units.

15. The image forming apparatus according to claim 13, further comprising additional multiple units including developer containers to store developer of different colors, respectively, wherein the positioning mechanism comprises a projection formed in one of the holder and the unit and a corresponding hole formed in the other of the holder and the unit to accommodate the projection as the unit is being installed in the image forming apparatus, and arrangements of the projections and the corresponding holes are different for each of the multiple units.

16. The image forming apparatus according to claim 13, wherein the positioning mechanism comprises a projection formed in one of the holder and the unit and a corresponding hole formed in the other of the holder and the unit to accommodate the projection as the unit is being installed in the image forming apparatus, and at least one of shapes and arrangements of the projections and the corresponding holes are different for different models of image forming apparatuses.

17. The image forming apparatus according to claim 13, wherein the unit comprises a development device having the developer container, and a development member to develop the latent image formed on the latent image carrier.

18. The image forming apparatus according to claim 13, wherein the unit comprises a process cartridge in which the developer container, the latent image carrier to carry the latent image, and a development member to develop the latent image formed on the latent image carrier are integrated as a single unit.

19. A positioning structure for positioning a unit within an image forming apparatus, comprising:

optical elements having a light-emitting element to emit light and a light-receiving element to receive light;

light-guiding members, to guide the light emitted from the light-emitting element to the light-receiving element, provided in the unit;

a containing space formed in a vertical wall of the image forming apparatus, defined by a bottom and side faces in the vertical wall;

a planar holder smaller than the containing space in a direction orthogonal to optical axes of the optical elements and accommodated within the containing space of the image forming apparatus, movable in a direction orthogonal to the optical axes of the optical elements as the unit is being installed in the image forming apparatus;

a projection formed in one of the holder and the unit; and a hole formed in the other of the holder and the unit to accommodate the projection as the unit is being installed in the image forming apparatus, wherein the holder is held by the bottom of the containing space in a state in which the unit is not installed in the image forming apparatus, the holder is moved by inserting the projection into the hole when the unit is being installed in the image forming apparatus, and the holder is held by the projection that is fitted into the hole to restrict the movement of the holder in the direction orthogonal to the optical axes of the optical elements relative to the unit in a state in which the unit is installed in the image forming apparatus.

20. The positioning structure according to claim 19, further comprising:

an engagement protrusion, whose length is shorter than the projection, formed in one of the holder and the unit;

an engagement hole to accommodate the engagement protrusion as the unit is being installed in the image forming apparatus to restrict rotation of the holder around the projection relative to the unit after the projection is inserted into the hole, formed in the other of the holder and unit; and two grooves, formed adjacent to the engagement hole and extending in a direction in which the holder rotates around the projection, wherein the grooves guide a tip of the engagement protrusion to the engagement hole as the unit is being installed in the image forming apparatus when the engagement protrusion is deviated from the engagement hole after the projection is inserted into the hole.

21. A developer amount detector for detecting an amount of developer contained in a developer container in a unit that is removably installable in an image forming apparatus, the developer amount detector comprising:

optical elements having a light-emitting element to emit light and a light-receiving element to receive the light for detecting the amount of the developer in the unit;

light-guiding members, provided in the unit, to guide the light emitted from the light-emitting element to the light-receiving element;

a holder, held in the image forming apparatus, to hold the optical elements, movable in a direction orthogonal to optical axes of the optical elements as the unit is being installed in the image forming apparatus; and a positioning mechanism to position the unit within the image forming apparatus by restricting movement of the holder in the direction orthogonal to the optical axes of the optical elements relative to the unit in a state in which the unit is installed in the image forming apparatus, wherein the positioning mechanism comprises:

a projection formed in one of the holder and the unit, and a hole formed in the other of the holder and the unit to accommodate the projection as the unit is being installed in the image forming apparatus.

* * * * *